US012245631B2

(12) United States Patent
Kim et al.

(10) Patent No.: US 12,245,631 B2
(45) Date of Patent: Mar. 11, 2025

(54) AEROSOL GENERATING DEVICE

(71) Applicant: KT&G CORPORATION, Daejeon (KR)

(72) Inventors: Jeong Hoo Kim, Chungcheonbuk-do (KR); Woo Seok Chung, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 722 days.

(21) Appl. No.: 17/420,242

(22) PCT Filed: Oct. 7, 2020

(86) PCT No.: PCT/KR2020/013682
§ 371 (c)(1),
(2) Date: Jul. 1, 2021

(87) PCT Pub. No.: WO2021/071256
PCT Pub. Date: Apr. 15, 2021

(65) Prior Publication Data

US 2022/0087317 A1 Mar. 24, 2022

(30) Foreign Application Priority Data

Oct. 11, 2019 (KR) ..... 10-2019-0126297

(51) Int. Cl.
*A24F 40/30* (2020.01)
*A24F 40/10* (2020.01)
(Continued)

(52) U.S. Cl.
CPC ..... *A24F 40/30* (2020.01); *A24F 40/10* (2020.01); *A24F 40/20* (2020.01); *A24F 40/42* (2020.01);
(Continued)

(58) Field of Classification Search
None
See application file for complete search history.

(56) References Cited

U.S. PATENT DOCUMENTS 10,973,259 B2 4/2021 Reevell
2017/0238611 A1 8/2017 Buchberger
(Continued)

FOREIGN PATENT DOCUMENTS

CN 204560971 U 8/2015
CN 106659250 A 5/2017
(Continued)

OTHER PUBLICATIONS

WO2015180027 English Translation obtained from Espacenet, pp. 1-14 (Year: 2024).*
(Continued)

*Primary Examiner* — Philip Y Louie
*Assistant Examiner* — Virginia R Bieger
(74) *Attorney, Agent, or Firm* — Sughrue Mion, PLLC

(57) ABSTRACT

An aerosol generating device includes: a housing; a cigarette accommodation portion located in the housing and configured to accommodate a cigarette through an opening formed at a first side of the cigarette accommodation portion; a heater unit located in the cigarette accommodation portion and configured to generate heat; and a cartridge accommodation portion adjoining a second side of the cigarette accommodation portion and configured to accommodate a cartridge for storing a liquid composition, wherein an end of the heater unit is connected to the cartridge accommodation portion, and a hollow tube is formed in the heater unit such that the liquid composition stored in the cartridge is transferred to the cigarette accommodation portion through the hollow tube.

11 Claims, 7 Drawing Sheets

(51) Int. Cl.

| | |
|---|---|
| ***A24F 40/20*** | (2020.01) |
| ***A24F 40/42*** | (2020.01) |
| ***A24F 40/46*** | (2020.01) |
| ***A24F 40/485*** | (2020.01) |
| ***A24F 40/60*** | (2020.01) |

(52) U.S. Cl.
CPC ..... *A24F 40/46* (2020.01); *A24F 40/485* (2020.01); *A24F 40/60* (2020.01)

(56) References Cited

U.S. PATENT DOCUMENTS

| | | | |
|---|---|---|---|
| 2017/0280778 | A1 | 10/2017 | Force |
| 2019/0373957 | A1 | 12/2019 | Bright et al. |
| 2020/0154765 | A1 | 5/2020 | Lee et al. |
| 2020/0154768 | A1 | 5/2020 | Han et al. |
| 2020/0229495 | A1 | 7/2020 | Buchberger |
| 2020/0359683 | A1 | 11/2020 | Reevell |
| 2021/0127742 | A1 | 5/2021 | Kim et al. |

FOREIGN PATENT DOCUMENTS

| | | | | |
|---|---|---|---|---|
| CN | 108685180 | A | 10/2018 | |
| CN | 108778008 | A | 11/2018 | |
| JP | 2018-532392 | A | 11/2018 | |
| JP | 2019-71886 | A | 5/2019 | |
| KR | 20-2012-0006994 | U | 10/2012 | |
| KR | 10-2018-0091831 | A | 8/2018 | |
| KR | 10-2019-0049392 | A | 5/2019 | |
| KR | 10-2019-0078564 | A | 7/2019 | |
| WO | WO-2015180027 | A1 * | 12/2015 | ..... A24F 47/00 |
| WO | 2016/161673 | A1 | 10/2016 | |
| WO | WO-2017207419 | A1 * | 12/2017 | ..... A24B 15/167 |
| WO | 2018/177826 | A1 | 10/2018 | |
| WO | 2018/190606 | A1 | 10/2018 | |
| WO | 2018/190607 | A2 | 10/2018 | |
| WO | WO-2018189195 | A1 * | 10/2018 | ..... A24D 1/20 |
| WO | WO-2019183537 | A1 * | 9/2019 | ..... A24F 47/008 |

OTHER PUBLICATIONS

Notification of Reasons for Refusal dated Oct. 4, 2022 from the Japanese Patent Office in Application No. 2021-544928.

Extended European Search Report issued Dec. 16, 2021 in European Application No. 20874419.3.

Korea Office action for Korean application 10-2019-0126297 dated Mar. 8, 2021.

Written opinion for PCT/KR2020/013682 dated Apr. 2, 2021.

International search report for PCT/KR2020/013682 dated Apr. 2, 2021.

Office Action dated Apr. 12, 2023 from the Chinese Patent Office in Application No. 202080013706.5.

* cited by examiner

AEROSOL GENERATING DEVICE

TECHNICAL FIELD

One or more embodiments relate to an aerosol generating device, and more particularly, to an aerosol generating device including a heater unit with a hollow tube for transferring a liquid composition.

BACKGROUND ART

Recently, the demand for alternative methods to overcome the shortcomings of general cigarettes has increased. For example, there is growing demand for a method of generating aerosol by heating an aerosol generating material in cigarettes, rather than by combusting cigarettes. Accordingly, studies on a heating-type cigarette and a heating-type aerosol generating device have been actively conducted.

DISCLOSURE

Technical Problem

Aerosol generating devices according to the related art require a liquid composition transfer element to transfer a liquid composition stored in a cartridge to a heating unit. The liquid composition transfer element extends from the cartridge to the heating unit. The liquid composition transfer element may include, for example, a porous material capable of absorbing the liquid composition.

This separate liquid composition transfer element may serve as a factor that makes it difficult to simplify the internal structure of the aerosol generating device.

Technical Solution

An aerosol generating device according to one or more embodiments relates to an aerosol generating device including a heater unit with a hollow tube for transferring a liquid composition. The heater unit of the aerosol generating device not only heats the liquid composition, but also transfers the liquid composition stored in the cartridge to a desired certain position.

An aerosol generating device according to one or more embodiments includes a heater unit that transfers and heats a liquid composition simultaneously.

An aerosol generating device according to one or more embodiments includes a heater unit that heats and transfers a liquid composition and a granular composition.

The technical solutions of embodiments are not limited to the specific examples set forth herein, however, different solutions may be implemented in many forms.

Advantageous Effects

A heater unit of an aerosol generating device according to one or more embodiments includes a hollow tube for transferring a liquid composition such that the liquid composition can be transferred and heated simultaneously. Thus, an aerosol can be more quickly and efficiently generated in the aerosol generating device.

An aerosol generating device according to one or more embodiments can generate an aerosol without a separate liquid composition transfer element. The internal configuration of the aerosol generating device can be simplified, and the aerosol generating device can be miniaturized. As the aerosol generating device is miniaturized, a user can more easily carry and use the aerosol generating device.

BEST MODE

Figure 1A:
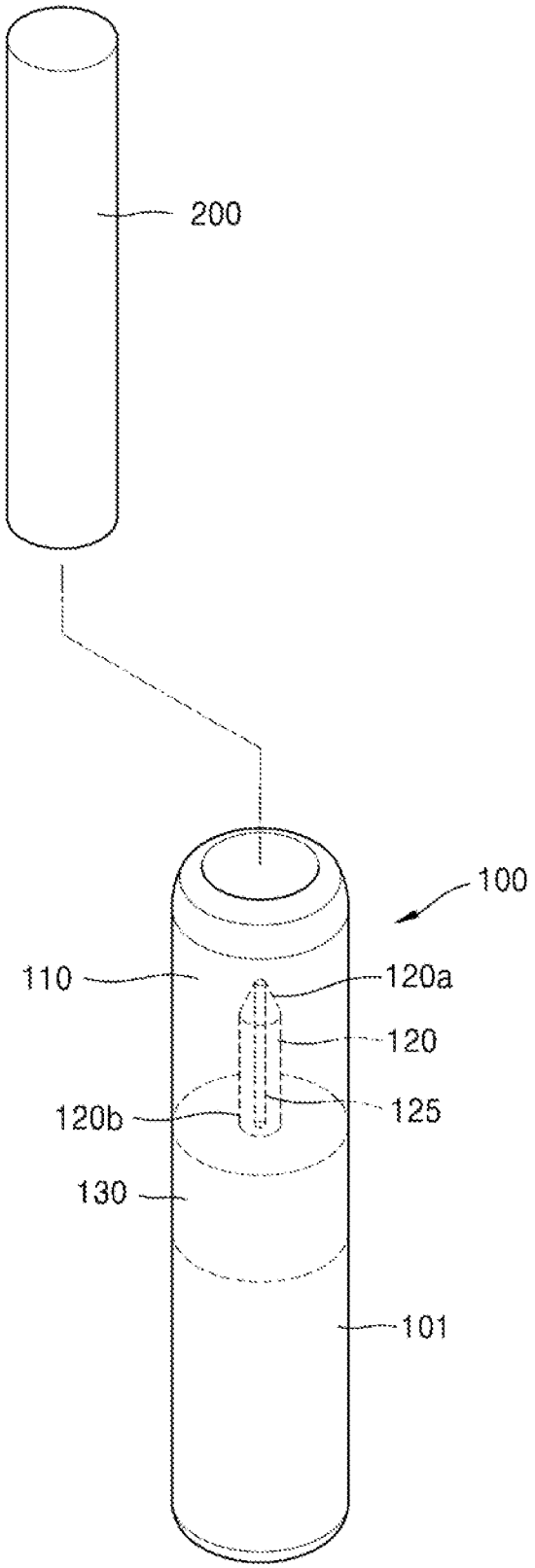
FIG. 1A is a perspective view of an aerosol generating device and a cigarette according to an embodiment.

According to one or more embodiments, an aerosol generating device may include a housing; a cigarette accommodation portion located in the housing and configured to accommodate a cigarette through an opening formed at a first side of the cigarette accommodation portion; a heater unit located in the cigarette accommodation portion and configured to generate heat; and a cartridge accommodation portion adjoining a second side of the cigarette accommodation portion and configured to accommodate a cartridge for storing a liquid composition, wherein an end of the heater unit is connected to the cartridge accommodation portion, and a hollow tube is formed in the heater unit such that the liquid composition stored in the cartridge is transferred to the cigarette accommodation portion through the hollow tube.

The heater unit may include an inlet port through which the liquid composition in the cartridge is introduced into the hollow tube.

The liquid composition in the cartridge may be discharged to the cigarette accommodation portion through an outlet port formed on another end of the heater unit.

The heater unit may be configured to transfer heat into the hollow tube such that the liquid composition is vaporized into a vapor composition when passing through the hollow tube, and the vapor composition may be introduced into the cigarette accommodated in the cigarette accommodation portion.

The cigarette accommodation portion, the heater unit, and the cartridge accommodation portion may be arranged in series in the housing of the aerosol generating device.

The aerosol generating device may further include a switch configured to control opening and closing of the inlet port and the outlet port of the heater unit.

The switch may protrude from the housing of the aerosol generating device.

The housing may include a cover portion that surrounds at least part of the cartridge accommodation portion such that the cartridge may be removed from the cartridge accommodation portion through the cover portion.

The aerosol generating device may further include a pad accommodation portion adjoining the cartridge accommodation portion such that the cartridge accommodation portion is disposed between the cigarette accommodation portion and the pad accommodation portion, and configured to accommodate a pad that contains a granular composition.

The heater unit may pass through the cartridge accommodation portion and extends to the pad accommodation portion such that heat generated by the heater unit is transferred to the pad, and the pad is configured to release flavor such that the flavor is moved to the cigarette accommodation portion through the hollow tube.

The heater unit may include: a first inlet port through which the flavor released from the pad is introduced into the hollow tube, a second inlet port through which the liquid composition in the cartridge is introduced into the hollow tube, and an outlet port through which the flavor introduced through the first inlet port and the liquid composition introduced through the second inlet port are discharged to the cigarette accommodation portion.

The liquid composition may be heated and vaporized into a vapor composition when passing through the hollow tube.

MODE FOR INVENTION

With respect to the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification refer to units for processing at least one function and operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

In addition, terms used in the present specification are for describing the embodiments and are not intended to limit the embodiments. In the present specification, the singular form also includes the plurality form unless specifically stated in the phrase.

Throughout the specification, the "longitudinal direction" of a component may be a direction in which the component extends along an axis in one direction of the component, wherein the axis in one direction of the component extends longer than an axis in the other direction of the component crossing the axis in one direction of the component. For example, the "longitudinal direction" of a heater unit 120 may be a direction in which the heater unit 120 extends along an axis (vertical axis) in one direction of the heater unit 120.

Figure 1B:
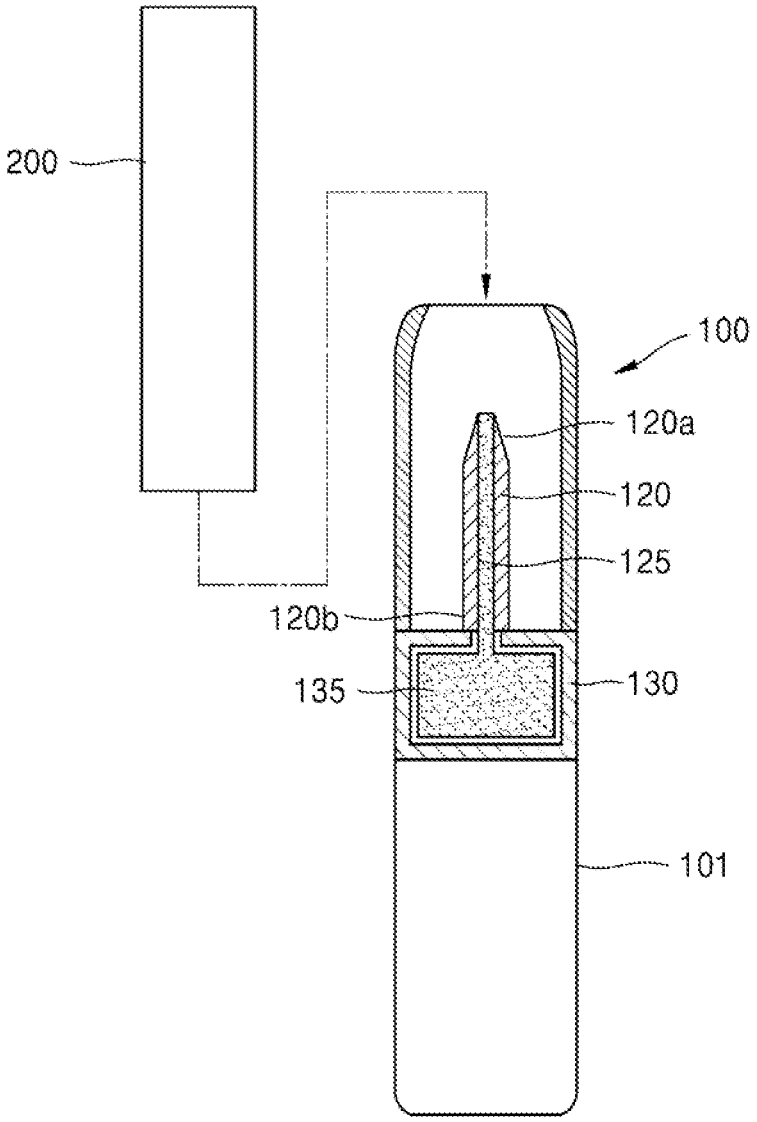
FIG. 1B is a cross-sectional view of the aerosol generating device and the cigarette shown in FIG. 1A.

FIG. 1A is a perspective view of an aerosol generating device 100 and a cigarette 200 according to an embodiment, and FIG. 1B is a cross-sectional view of the aerosol generating device 100 and the cigarette 200 shown in FIG. 1A.

The aerosol generating device 100 according to an embodiment may include a cigarette accommodation portion 110 which is located in a housing 101 of the aerosol generating device 100 and accommodates the cigarette 200 inserted into one side (hereinafter "first side") of the cigarette accommodation portion 110, a heater unit 120 which is located in the cigarette accommodation portion 110 and heats the accommodated cigarette 200, and a cartridge accommodation unit 130 which is located on the other side (hereinafter "second side") of the cigarette accommodation portion 110 and accommodates a cartridge 135 for storing a liquid composition. One end 120*a* (hereinafter "first end") of the heater unit 120 may be located on the cigarette accommodation portion 110, and the other end 120*b* (hereinafter "second end") of the heater unit 120 is located on the cartridge accommodation portion 130. A hollow tube 125 may be formed inside the heater unit 120 such that the liquid composition stored in the cartridge 135 may be transferred to the cigarette accommodation portion 110.

The aerosol generating device 100 according to an embodiment may include the cigarette accommodation portion 110. The cigarette accommodation portion 110 may be located in the housing 101 of the aerosol generating device 100 and may accommodate the cigarette 200 inserted into the first side of the cigarette accommodation portion 110. The cigarette accommodation portion 110 may be located, for example, on one end of the housing 101 and may accommodate the cigarette 200 inserted into the first side of the cigarette accommodation portion 110.

The cigarette accommodation portion 110 may have a shape and a size corresponding to the cigarette 200 to accommodate the cigarette 200. For example, when the cigarette 200 has a cylindrical shape, the cigarette accommodation portion 110 may also have a cylindrical shape to accommodate the cigarette 200. However, the shape of the cigarette 200 and the cigarette accommodation portion 110 is not limited thereto and may be changed as needed.

The aerosol generating device 100 according to an embodiment may include the heater unit 120 which is located in the cigarette accommodation portion 110 and heats the accommodated cigarette 200. For example, when the cigarette 200 is inserted into the cigarette accommodation portion 110 of the aerosol generating device 100, the heater unit 120 may be inserted into the cigarette 200 and may heat the cigarette 200. As another example, the heater unit 120 may be located outside the cigarette 200 and may heat an outside of the cigarette 200.

The heater unit 120 may be an electrically resistive heater unit 120. For example, the heater unit 120 may include a conductive track, and the heater unit 120 may be heated as current flows through the conductive track. However, the heater unit 120 is not limited to the above-described example, and may be applicable without limitation as long as it may be heated to a desired temperature. Here, the desired temperature may be temperature preset in the aerosol generating device 100 or temperature set by a user.

As another example, the heater unit 120 may be an induction heater unit. Specifically, the heater unit 120 may include an electrically conductive coil for heating the cigarette 200 in an induction heating method, and the cigarette 200 may include a susceptor that may be heated by the induction heater unit 120.

The heater unit 120 may include at least one of a tube-type heating element, a plate-type heating element, a needle-type heating element, and a rod-type heating element, and may heat the inside or outside of the cigarette 200, according to the shape of the heating element.

The aerosol generating device 100 according to an embodiment may include a cartridge accommodation portion 130 which is located on the second side (i.e., bottom) of the cigarette accommodation portion 110 and accommodates the cartridge 135 for storing the liquid composition.

The cartridge accommodation portion 130 may be located on the second side of the cigarette accommodation portion 110. That is, the cartridge accommodation portion 130 may be located on the opposite side to the opening through the cigarette 200 is inserted in the cigarette accommodation portion 110.

The cartridge accommodation portion 130 may accommodate the cartridge 135 for storing the liquid composition. The liquid composition stored in the cartridge 135 may include, for example, water, a solvent, ethanol, plant extract, spices, flavorings, or a vitamin mixture. The spices may include menthol, peppermint, spearmint oil, and various fruit-flavored ingredients, but are not limited thereto.

The flavorings may include ingredients capable of providing various flavors or tastes to the user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Components of the aerosol generating device 100 according to an embodiment are not limited to the components shown in the drawings, but may further include additional components.

For example, the aerosol generating device 100 according to an embodiment may further include a battery (not shown) for supplying power to the heater unit 120.

The battery may supply power used to operate the aerosol generating device 100. For example, the battery may supply power so that the heater unit 120 may be heated. Also, the battery may supply power required to operate a display, a sensor, a motor, etc., which may be installed in the aerosol generating device 100.

The first end 120*a* of the heater unit 120 of the aerosol generating device 100 according to an embodiment may be located at the cigarette accommodation portion 110, and the second end 120*b* of the heater unit 120 may be located at the cartridge accommodation portion 130. The heater unit 120 may extend from the cigarette accommodation portion 110 to the cartridge accommodation portion 130.

A hollow tube 125 may be formed inside the heater unit 120 of the aerosol generating device 100 according to an embodiment. The hollow tube 125 may be formed in the heater unit 120 along a longitudinal direction of the heater unit 120 and may have the same longitudinal axis as the heater unit 120.

The hollow tube 125 may transfer the liquid composition stored in the cartridge 135 to the cigarette accommodation portion 110. One end of the hollow tube 125 may be open to the cigarette accommodation portion 110, and the other end of the hollow tube 125 may be open to the cartridge accommodation portion 130.

The liquid composition stored in the cartridge 135 may be transferred to the cigarette accommodation portion 110 from the cartridge accommodation portion 130 during the user's inhalation. For example, a pressure between the first end 120*a* and the second end 120*b* of the hollow tube 125 may change according to the pressure change inside the cigarette accommodation portion 110 due to inhalation. The pressure change between the first end 120*a* and the second end 120*b* of the hollow tube 125 may allow the liquid composition stored in the cartridge 135 to be moved to the cigarette accommodation portion 110.

The heater unit 120 may include a power unit (not shown) that moves the liquid composition stored in the cartridge 135 to the cigarette accommodation portion 110. The power unit may be arranged near the cartridge accommodation portion 130. For example, the power unit may be a pump. The power unit may receive power from the battery and may draw the liquid composition stored in the cartridge 135 into the hollow tube 125 inside the heater unit 120. The liquid composition passing through the hollow tube 125 may be transferred to the cigarette accommodation portion 110.

The cigarette accommodation portion 110, the heater unit 120, and the cartridge accommodation portion 130 of the aerosol generating device 100 according to an embodiment may be arranged in series in the housing 101 of the aerosol generating device 100. For example, the cigarette accommodation portion 110, the heater unit 120, and the cartridge accommodation portion 130 may be arranged in series in the longitudinal direction of the housing 101. Other components of the aerosol generating device 100 that are not shown in the drawings may be arranged in series in the housing 101 of the aerosol generating device 100.

As the cigarette accommodation portion 110, the heater unit 120 and the cartridge accommodation portion 130 are arranged in parallel in the housing 101, the aerosol generating device 100 according to an embodiment may have an elongated shape. For example, the aerosol generating device 100 may extend longer in a longitudinal direction (i.e., a direction in which the cigarette 200 is accommodated) than it extends in a width direction transverse to the longitudinal direction. The ratio of the length to the width of the housing 101 may be set to be easily grasped and carried by the user and may be changed as needed.

The cigarette 200 that may be inserted into the aerosol generating device 100 according to an embodiment may include a base portion including an aerosol generating material. The aerosol generating material may be at least one of glycerin, propylene glycol, ethylene glycol, dipropylene glycol, diethylene glycol, triethylene glycol, tetraethylene glycol, and oleyl alcohol and is not limited thereto.

The cigarette 200 may include a medium portion including a medium. The medium portion may be a tobacco including nicotine. The medium portion may be formed in various ways. The medium portion may be formed as, for example, a sheet or a strand. Also, the medium portion may be formed as a pipe tobacco, which is formed of tiny bits cut from a tobacco sheet.

In this document, components having the same reference numerals as those shown in FIGS. 1A and 1B may be the same as those described in FIGS. 1A and 1B, and detailed descriptions in an overlapping range will be omitted.

Figure 2:
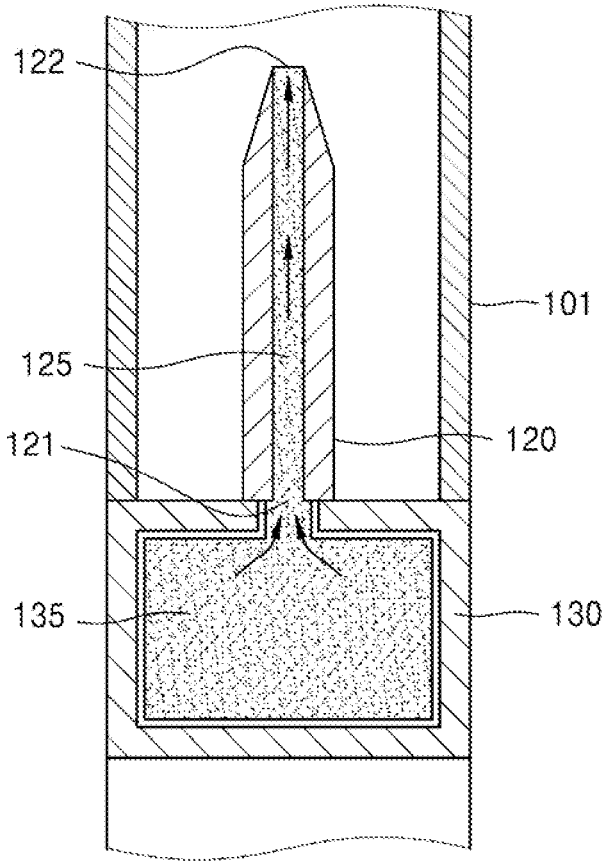
FIG. 2 is a cross-sectional view of a heater unit of the aerosol generating device shown in FIG. 1A.

FIG. 2 is a cross-sectional view of the heater unit 120 of the aerosol generating device 100 shown in FIG. 1A.

An outlet port 122 may be formed on the first end 120*a* of the heater unit 120 of the aerosol generating device 100 according to an embodiment, and an inlet port 121 may be formed at the second end 120*b* of the heater unit 120. The inlet port 121 and the outlet port 122 may be in fluid communication with each other through the hollow tube 125.

The liquid composition stored in the cartridge 135 may be introduced into the hollow tube 125 through the inlet port 121 formed on the second end 120*b* of the heater unit 120. The liquid composition introduced through the inlet port 121 may be transferred to the outlet port 122 formed on the first end 120*a* of the heater unit 120 through the hollow tube 125, and subsequently, may be discharged to the cigarette accommodation portion 110 through the outlet port 122.

The liquid composition stored in the cartridge 135 of the aerosol generating device 100 according to an embodiment may be heated and atomized into a vapor composition while passing through the hollow tube 125. Heat generated by the heater unit 120 may be transferred to the hollow tube 125 formed in the heater unit 120. Heat transferred to the hollow tube 125 may be used to atomize the liquid composition, which turns into the vapor composition.

Subsequently, the vapor composition may be transferred to the cigarette accommodation portion 110 and may be introduced into the cigarette 200. The vapor composition introduced into the cigarette 200 may be provided to the user together with the aerosol generated by heating the cigarette 200.

The vapor composition may provide various flavors or tastes to the aerosol, or an aerosol forming material such as glycerin and propylene glycol may be additionally provided to the aerosol generated by heating the cigarette 200.

Figure 3:
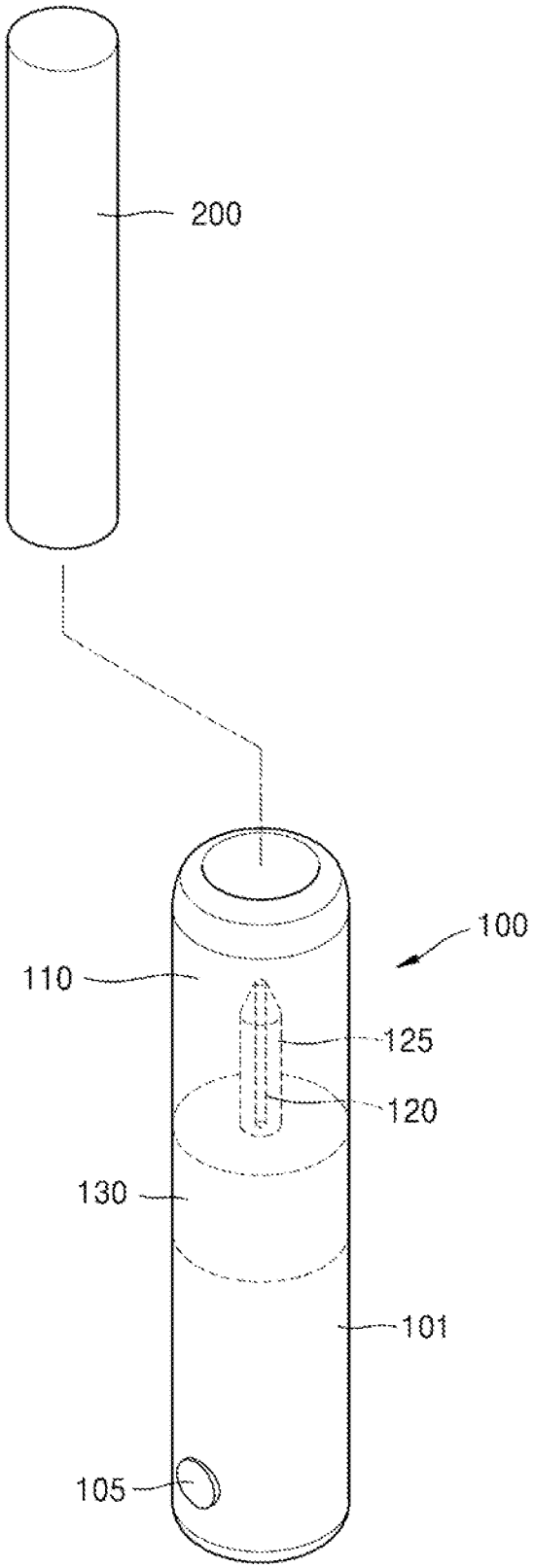
FIG. 3 is a perspective view of an aerosol generating device and a cigarette according to another embodiment.

FIG. 3 is a perspective view of an aerosol generating device 100 and a cigarette 200 according to another embodiment.

The aerosol generating device 100 according to the present embodiment may further include a switch 105 that controls opening/closing of the inlet port 121 and the outlet port 122 of the heater unit 120 for transferring the liquid composition.

The switch 105 may protrude from the housing 101 of the aerosol generating device 100. The switch 105 that protrudes from the housing 101 may be exposed to the user. The user may turn on or off the switch 105, thereby controlling opening/closing of the inlet port 121 and the outlet port 122 of the heater unit 120. For example, when the user pushes the switch 105, the switch 105 may be moved from a first position to a second position and may be turned on, and when the user pushes the switch 105 again, the switch 105 may be moved from the second portion to the first position and may be turned off.

When the user turns on the switch 105, the inlet port 121 and the outlet port 122 of the heater unit 120 may be opened. As the inlet port 121 and the outlet port 122 are opened, the liquid composition stored in the cartridge 135 may flow into the hollow tube 125 of the heater unit 120 through the inlet port 121. The liquid composition that flows into the hollow tube 125 may be discharged to the cigarette accommodation portion 110 through the opened outlet port 122.

When the user turns off the switch 105, the inlet port 121 and the outlet port 122 of the heater unit 120 may be closed. As the inlet port 121 and the outlet port 122 are closed, the liquid composition stored in the cartridge 135 may be prevented from flowing into the cigarette accommodation portion 110 through the hollow tube 125 of the heater unit 120.

The user may turn on or off the switch 105 to change the contents and flavors of the aerosol generated by the aerosol generating device 100. That is, the flow of the liquid composition may be determined according to on/off of the switch 105, and the flavors or contents of the aerosol inhaled by the user may be changed.

Figure 4:
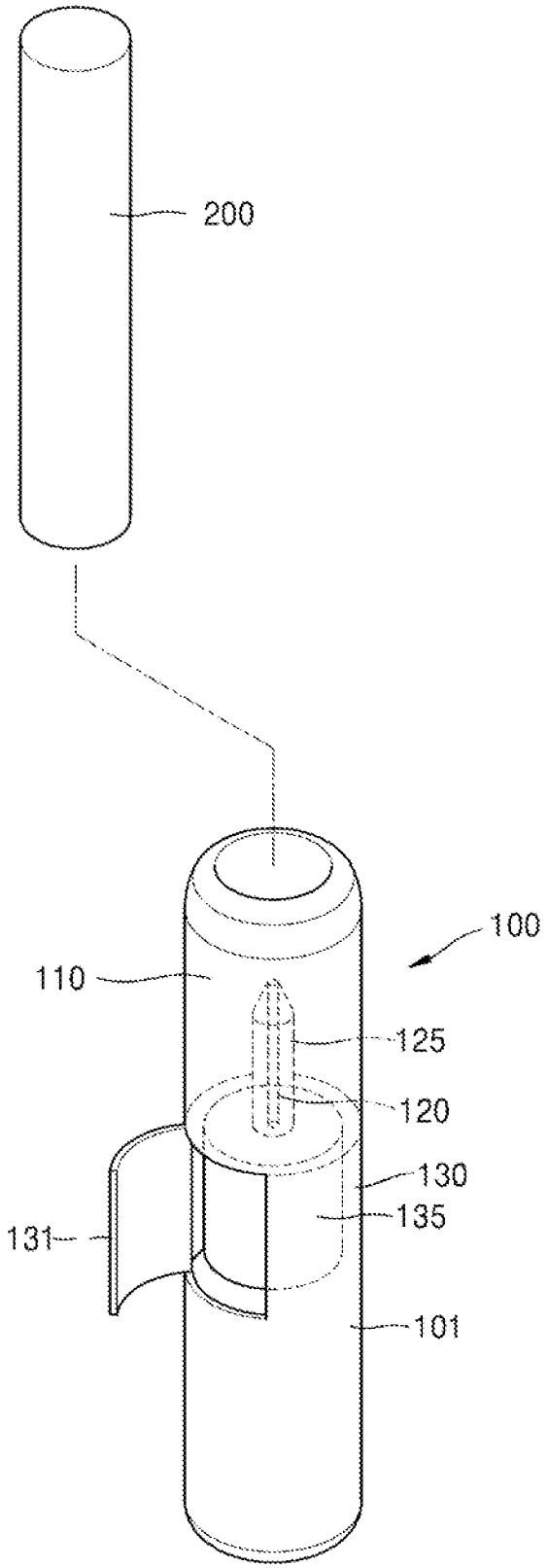
FIG. 4 is a perspective view of an aerosol generating device and a cigarette according to another embodiment.

FIG. 4 is a perspective view of an aerosol generating device 100 and a cigarette 200 according to another embodiment.

The housing 101 of the aerosol generating device 100 according to the present embodiment may include a cover portion 131 that surrounds at least part of the cartridge accommodation portion 130. The cartridge 135 may be removed from the cartridge accommodation portion 130 through the cover portion 131.

The cover portion 131 of the aerosol generating device 100 according to an embodiment may be arranged at a position of the housing 101 corresponding to the cartridge accommodation portion 130. The cover portion 131 may be formed to surround at least part of the cartridge accommodation portion 130.

The cartridge 135 may be detachable from the cartridge accommodation portion 130 through the cover portion 131. When the liquid composition stored in the cartridge 135 is used up, replacement of the cartridge 135 accommodated in the cartridge accommodation portion 130 may be required. The user may replace the cartridge 135 through the cover portion 131.

For example, the user may open the cover portion 131 and access the cartridge accommodation portion 130. When the cover portion 131 is opened, it may form an opening that provides access to the cartridge accommodation portion 130. The opening may have a suitable size and shape for a user to detach the cartridge 135 from the cartridge accommodation portion 130.

When the cover portion 131 opens the cover portion 131, the user may remove the old cartridge 135 mounted on the cartridge accommodation portion 130 and mount a new cartridge 135. For example, the cover portion 131 may be opened and closed by a hinge. However, an opening/closing method of the cover portion 131 is not limited thereto, and may be changed as needed.

Figure 5A:
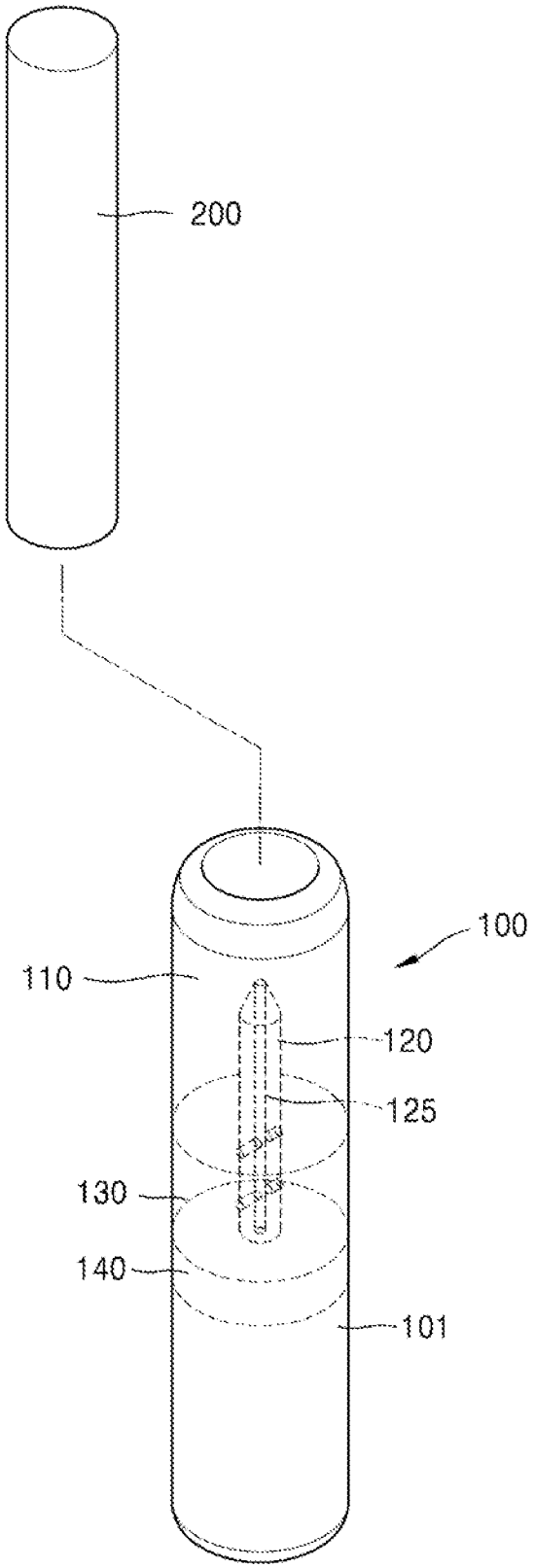
FIG. 5A is a perspective view of an aerosol generating device and a cigarette according to another embodiment.
Figure 5B:
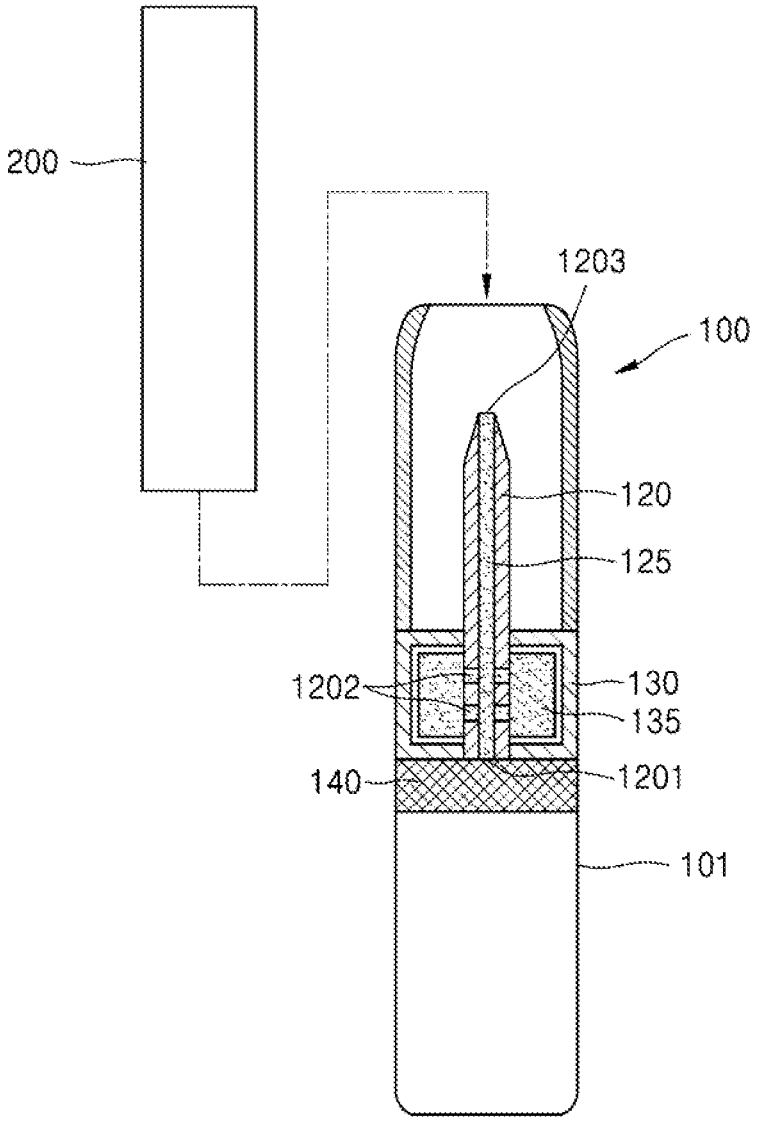
FIG. 5B is a cross-sectional view of an aerosol generating device and a cigarette shown in FIG. 5A.

FIG. 5A is a perspective view of an aerosol generating device 100 and a cigarette 200 according to another embodiment, and FIG. 5B is a cross-sectional view of the aerosol generating device 100 and the cigarette 200 shown in FIG. 5A.

The aerosol generating device 100 according to the present embodiment may further include a pad accommodation portion 140 for accommodating a pad (not shown) that is located under the cartridge accommodation portion 130.

That is, the accommodation portion 130 may be positioned between the cigarette accommodation portion 110 and the pad accommodation portion 140. The pad accommodated in the pad accommodation portion 140 may include a granular composition. The granular composition may be a material in a solid state.

The granular composition may include a flavoring material that releases flavor by heating. The flavoring material may be a natural material such as herbal granules, or a material such as silica, zeolite, or dextrin including a fragrance component.

The granular composition may also contain licorice, sucrose, fructose syrup, isosweet, cocoa, lavender, cinnamon, cardamom, celery, fenugreek, cascarilla, sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, cilantro, or coffee.

In the aerosol generating device 100 according to an embodiment, the heater unit 120 may pass through the cartridge accommodation portion 130 and may extend to the pad accommodation portion 140. That is, the heater unit 120 may extend from the cigarette accommodation portion 110 to the pad accommodation portion 140 through the cartridge accommodation portion 130.

The pad may receive heat transferred from the heater unit 120. Heat transferred from the heater unit 120 may be used to heat the flavoring material of the pad. The flavoring material may be heated, thereby releasing flavor. The flavor released from the pad may be changed according to the type of the flavoring material contained in the pad.

For example, when the flavoring material contained in the pad is mint, the pad release mint flavor when heated by heat transferred from the heater unit 120. The flavor released from the pad may be moved to the cigarette accommodation portion 110 through the hollow tube 125.

A first inlet port 1201 through which the flavor released from the pad is introduced, may be formed on the second end of the heater unit 120 of the aerosol generating device 100 according to an embodiment. The first inlet port 1201 may be open to the pad in a portion where the heater unit 120 comes in contact with the pad. The first inlet port 1201 may allow the flavor released from the pad to flow into the hollow tube 125.

A second inlet port 1202 through which the liquid composition of the cartridge 135 may flow, may be formed on the circumferential surface of the heater unit 120. The second inlet portion 1202 may allow the hollow tube 125 and the cartridge 135 to be in fluid communication with each other. As shown FIG. 5B, a plurality of second inlet portions 1202 may be formed on the circumferential surface of the heater unit 120 and may be formed in a direction transverse to the longitudinal direction of the heater unit 120.

An outlet port 1203 may be formed on one end of the heater unit 120 such that the flavor released from the pad and the liquid composition in the cartridge 135 may be discharged to the cigarette accommodation portion 110 through the outlet port 1203. The flavor introduced through the first inlet port 1201 of the heater unit 120 and the liquid composition introduced through the second inlet port 1202 of the heater unit 120 may pass through the hollow tube 125 and may be discharged to the cigarette accommodation portion 110 through the outlet port 1203 formed on one end of the heater unit 120. At this time, the liquid composition may be heated while passing through the hollow tube 125 and may be atomized into a vapor composition.

As aforementioned, the pad may release flavor by receiving heat transferred from the second end of the heater unit 120. The released flavor may be introduced into the hollow tube 125 through the first inlet port 1201 of the heater unit 120 and may be discharged to the cigarette accommodation portion 110 through the outlet port 1203. The liquid composition in the cartridge 135 may be introduced into the hollow tube 125 through the second inlet port 1202 and may be discharged to the cigarette accommodation portion 110 through the outlet port 1203. The liquid composition introduced into the hollow tube 125 through the second inlet port 1202 may be atomized into a vapor composition and discharged to the cigarette accommodation portion 110.

The flavor and the vapor composition may be mixed with each other and moved to the cigarette accommodation portion 110. The flavor and the vapor composition may be added to the aerosol generated from the cigarette 200 and delivered to the user.

A hollow tube 125 for transferring the liquid composition and the flavor may be formed in the heater unit 120 of the aerosol generating device 100, and may transfer and heat the liquid composition simultaneously. Thus, the aerosol may be more quickly and efficiently generated in the aerosol generating device 100.

Also, the aerosol generating device 100 according to an embodiment may generate an aerosol without a separate liquid composition transfer element, so the internal configuration of the aerosol generating device 100 may be simplified and the aerosol generating device 100 may be miniaturized.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

INDUSTRIAL APPLICABILITY

Embodiments relate to an aerosol generating device including a heater unit with a hollow tube for transferring a liquid composition.

The invention claimed is:

1. An aerosol generating device comprising:

a housing;

a cigarette accommodation portion located in the housing and configured to accommodate a cigarette through an opening formed at a first side of the cigarette accommodation portion;

a heater unit located in the cigarette accommodation portion and configured to generate heat;

a cartridge accommodation portion adjoining a second side of the cigarette accommodation portion and configured to accommodate a cartridge for storing a liquid composition; and a pad accommodation portion adjoining the cartridge accommodation portion such that the cartridge accommodation portion is disposed between the cigarette accommodation portion and the pad accommodation portion, and configured to accommodate a pad that contains a granular composition, wherein an end of the heater unit is connected to the cartridge accommodation portion, and a hollow tube is formed in the heater unit such that the liquid composition stored in the cartridge is transferred to the cigarette accommodation portion through the hollow tube, wherein the heater unit passes through the cartridge accommodation portion and extends to an edge of the pad accommodation portion such that heat generated by the heater unit is transferred to the pad, and wherein the heater unit further comprises a first inlet port open to the pad accommodation portion in a portion where the heater unit contacts the edge of the pad accommodation portion.

2. The aerosol generating device of claim 1, wherein the heater unit is configured to transfer heat into the hollow tube such that the liquid composition is vaporized into a vapor composition when passing through the hollow tube, and the vapor composition is introduced into the cigarette accommodated in the cigarette accommodation portion.

3. The aerosol generating device of claim 1, wherein the cigarette accommodation portion, the heater unit, and the cartridge accommodation portion are arranged in series in the housing of the aerosol generating device.

4. The aerosol generating device of claim 1, wherein a switch protrudes from the housing of the aerosol generating device.

5. The aerosol generating device of claim 1, wherein the housing comprises a cover portion that surrounds at least part of the cartridge accommodation portion such that the cartridge is removed from the cartridge accommodation portion through the cover portion.

6. The aerosol generating device of claim 1, wherein the pad is configured to release flavor such that the flavor is moved to the cigarette accommodation portion through the hollow tube.

7. The aerosol generating device of claim 6, wherein flavor released from the pad is introduced into the hollow tube through the first inlet port, and wherein the heater unit further comprises:

a second inlet port through which the liquid composition in the cartridge is introduced into the hollow tube, and an outlet port through which the flavor introduced through the first inlet port and the liquid composition introduced through the second inlet port are discharged to the cigarette accommodation portion.

8. The aerosol generating device of claim 1, wherein the heater unit comprises an inlet port through which the liquid composition in the cartridge is introduced into the hollow tube.

9. The aerosol generating device of claim 8, wherein the liquid composition in the cartridge is discharged to the cigarette accommodation portion through an outlet port formed on another end of the heater unit.

10. The aerosol generating device of claim 9, further comprising a switch configured to control opening and closing of the inlet port and the outlet port of the heater unit.

11. The aerosol generating device of claim 1, wherein the liquid composition is heated and vaporized into a vapor composition when passing through the hollow tube.

* * * * *